United States Patent [19]

Schneider et al.

[11] Patent Number: 4,553,288

[45] Date of Patent: Nov. 19, 1985

[54] CARD CLOTHING FOR CARDING SEGMENTS OF A CARDING MACHINE

[75] Inventors: Manfred Schneider, Karl-Marx-Stadt; Gerhard Barth, Dittersdorf; Johannes Barth, Niederwiesa; Wolfgang Neubert, Karl-Marx-Stadt, all of German Democratic Rep.

[73] Assignee: Veb Kombinat Textima, Karl-Marx-Stadt, German Democratic Rep.

[21] Appl. No.: 614,724

[22] Filed: May 25, 1984

Related U.S. Application Data

[63] Continuation-in-part of Ser. No. 566,818, Dec. 28, 1983.

[30] Foreign Application Priority Data

Dec. 30, 1982 [DD] German Democratic Rep. ... 246803

[51] Int. Cl.[4] ..... D01G 15/88

[52] U.S. Cl. ..... 19/113; 19/114

[58] Field of Search ..... 19/102, 103, 104, 110, 19/111, 113, 114

[56] References Cited

U.S. PATENT DOCUMENTS

| | | | |
|---|---|---|---|
| 254,651 | 3/1882 | Hoey | 19/114 |
| 1,154,856 | 9/1915 | Graf | 19/114 |
| 1,709,038 | 4/1929 | Platt | 19/114 |
| 2,785,443 | 3/1957 | Abeele | 19/113 |
| 4,287,643 | 9/1981 | Leifeld | 19/114 |
| 4,357,738 | 11/1982 | Siegrist | 19/114 |

FOREIGN PATENT DOCUMENTS

| | | | |
|---|---|---|---|
| 1155605 | 6/1969 | United Kingdom | 19/114 |

*Primary Examiner*—Louis K. Rimrodt
*Attorney, Agent, or Firm*—Michael J. Striker

[57] ABSTRACT

A card clothing for a stationary or movable carding segments of a carding machine includes at least two rows of groups of tips. The rows are located one after another in the direction of carding and each row extends transversally of the direction of carding. Each group has from two to six tips positioned one after another. The groups of the tips in the first row are laterally spaced from each other a distance equal to at least three widths of each group. The groups of tips arranged in the following row are laterally offset relative to the groups of the previous row, as seen in the direction of carding, a distance equal to at least the width of one group.

9 Claims, 14 Drawing Figures

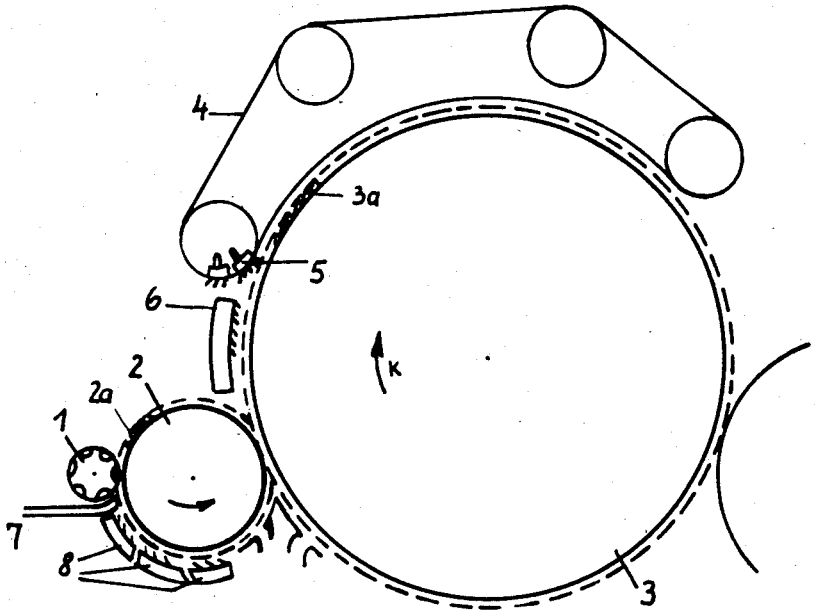
Fig. 1
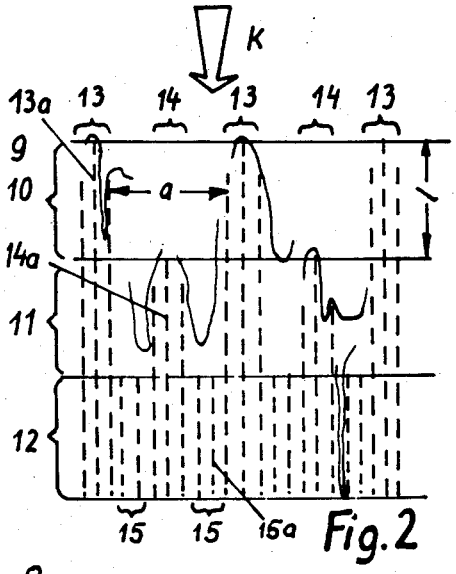
Fig. 2
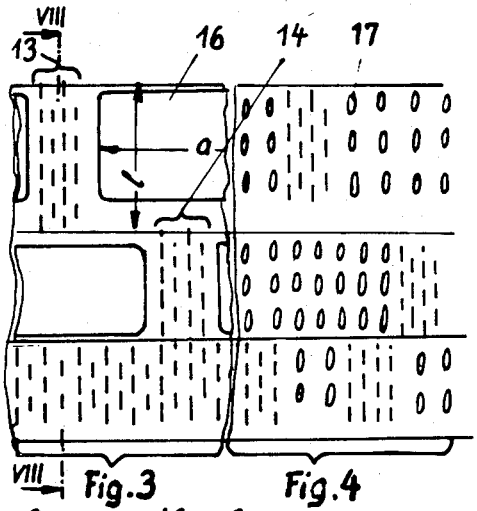
Fig. 3
Fig. 4
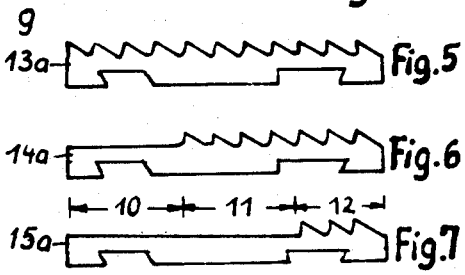
Fig. 5
Fig. 6
Fig. 7
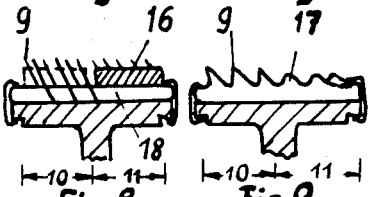
Fig. 8
Fig. 9

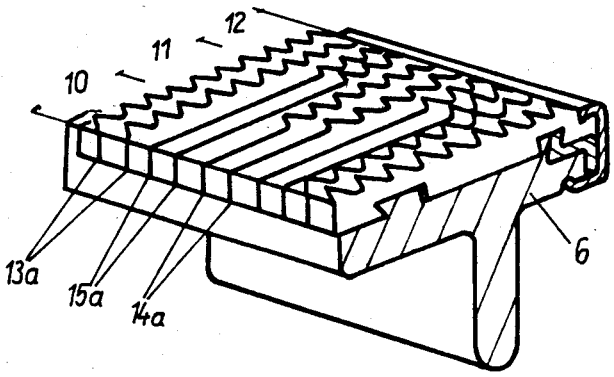
Fig 10
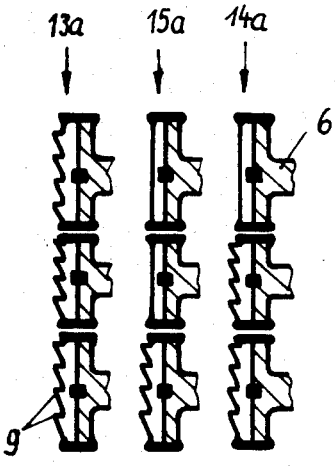
Fig 12
Fig 13
Fig 14
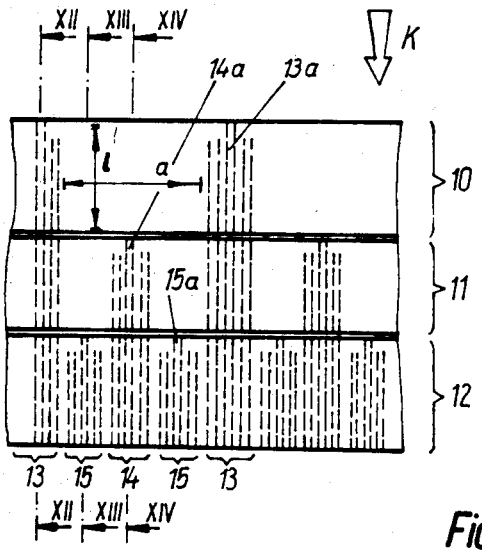
Fig 11

CARD CLOTHING FOR CARDING SEGMENTS OF A CARDING MACHINE

This application is a Continuation-in-Part of the application ser. No. 566,818 filed on Dec. 28, 1983.

BACKGROUND OF THE INVENTION

The present invention relates to carding segments of carding machines, particularly flat carding machines, in which carding segments are arranged against the circumference of a rotary drum provide with card clothing, which carding segments are stationary or longitudinally movable and provided with unevenly arranged tips cooperating with the card clothing of the drum.

It has been known in the art that wire card clothings of various depth, various stability and various height have been utilized on the lids of the lid chain of the carding machine. Such card clothings have been disclosed, for example in U.S. Pat. No. 3,151,362 or Japanese Pat. No. 54-40661.

It has also been known that individual lids can be covered with carding plates instead of card clothing. Many reasons could be found for such arrangements. These arrangements are satisfactory for improved refuse removal, deeper carding and for simple cleaning.

Known card clothing have been also described in German patent publications DE No. 2,617,796 and DE No. 2,226,914. A commonly known card clothing includes a plurality of tips arranged one after another. These tips, in spite of staggering difference in distance between individual tips, operate simultaneously. Such operation causes high carding forces, particularly in the inflow region, or on the carding segments positioned between the licker-in and the lid chain or on the lids of the lid chain. Extensive wear of the card clothing obviously results from such an arrangement. To avoid this disadvantage it has been suggested, as described in DE No. 52,874, to utilize rigid overall-steel card clothing in place of elastic card clothing. However, complicated processes and rare and expensive materials have been required to obtain the necessary hardness and wear properties of the rigid card clothing, as is disclosed in U.S. Pat. No. 3,833,968.

In order to substantially equalize carding forces, particularly those acting on the stationary carding segments, positioned between the licker-in and the lid chain, the tips of the card clothing are arranged at a different distance from each other so that the distance between the tips is decreased in the direction of carding. This resulted in increased carding output and a longer life span of the card clothing.

As has been mentioned above, conventional card clothings are expensive and it has been difficult to produce card clothings with a uniform hardness and good wear resistance. Furthermore, the life span of known card clothings has been substantially limited.

SUMMARY OF THE INVENTION

It is an object of the present invention to significantly reduce costs of manufacturing of card clothings, to avoid the utilization of rare materials and to increase life span of card clothings.

It is another object of the invention to reduce a number of points of engagements of the card elements, simultaneousl acting on individual fibers,to a required level and to avoid the formation of multiple loops per a fiber.

These and other objects of the invenion are attained by a card clothing for carding segments of a carding machine, particularly flat carding machine,in which carding segments are stationary or movably arranged against a circumference of a respective rotary drum having a card clothing on its circumference, the card clothing for the carding segments comprising a plurality of non-uniformly arranged tips cooperating with the card clothing of the respective drum, said tips being arranged in groups, said groups being arranged in at least two rows lying one after another in a direction of carding and each extending transversally to the direction of carding, each group being comprised of two to six tips located one after another and having a predetermined width, the groups in a first row, as viewed in the direction of carding, being laterally spaced from each other a distance which corresponds to at least three widths of one group of the tips, (or at least of 50% of the pile length), the groups each having an extension in the direction of carding corresponding to at least two widths of the group (at least 30% of the medium pile length), and the groups of a following row, as viewed in the direction of carding, being laterally offset at least at a distance corresponding to one width of the group relative to the groups of a previous row.

According to a further concept of the invention three rows of the groups of the tips may be provided, said three rows lying one after another in the direction of carding, said distance in said first row corresponding to three to four widths of one group of the tips.

Each following row in the direction of carding may include a greater number of groups than the previous row.

The distance between the groups in a second row, as viewed in the direction of carding, may correspond to about one width of the group, a third row may be fully covered with tips.

All three rows of the groups of the tips can be arranged on one carrier of the card clothing.

In order to ensure a stable and uniform inflow ratio it is expedient to arrange the carriers of the card clothing rigidly or detachably on the circumference of the tambour between the licker-in and the lid chain. Under these conditions only one row of the groups of the tips can be arranged on each carrier or carding segment and three carding segments with the rows of differently distributed tips can be arranged one after another.

The card clothing may further include plates arranged between the groups in one row, said plates each having an upper surface, the level of which is lower than that of the tips in the groups. The card clothing may also include projections formed between the groups in the region of said distance, said projections having stumps which are lower than the tips in the groups arranged in the successive rows. The heads of the stumps may be rounded.

The card clothing according to the invention can be utilized not only for carding segments employed with the tambour but also for carding segments cooperating with the licker-in which setments are located between the feeder of the carding machine and the tambour, below the licker-in. If the card clothing of the invention is utilized on the movable lids the tip-group-distribution similar to that as in the first row, as above, can be provided for all lids and the card clothing should be laterally displaced so that the carding would be performed over the whole width thereof.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 1 is a schematic view of a flat carding machine;

FIG. 2 is a top plan view of the wire card clothing of a carding segment;

FIG. 3 is a top plan view of the card clothing of the carding segment of another embodiment of the invention;

FIG. 4 is a top plan view of the card clothing of the carding segment of still another embodiment of the invention;

FIGS. 5 through 9 illustrate side views of various shapes of the carding elements;

FIG. 10 is a perspective view of an individual carding segment with a carding clothing comprised of various carding elements;

FIG. 11 is a top plan view of the card clothing provided on three separate carding segments; and . FIGS. 12 through 14 illustrate side views of carding elements of various shapes.

DETAILED DESCRIPTION OF THE PREFERRED EMBODIMENTS

Referring now to the drawings, and first to FIG. 1, a carding machine includes the following important components necessary for a carding process, namely a feeding roll 1, a licker-in 2 and a main cylinder 3. A commonly known cover chain 4, which includes a number of elongated rotary carding segments or flats 5, is located above tambour 3. Cover chain 4 is further provided with stationary carding segments 6 which are positioned between licker-in 2 and chain 4.

Licker-in carding segments 8 can also be arranged immediately below the feeding roll 1 and a feeder 7.

Flats 5, carding segments 6 and licker-in carding segments 8 have tips 9 which are directed against a rotational movement of the corresponding drums 2, 3. Drums 2 and 3, namely the licker-in and the main cylinder, each carries on the respective circumference thereof a wire card clothing, preferably an overall steel card clothing, the tips 2*a*, 3*a* of which are inclined in the direction of rotation and are uniformaly distributed over the respective circumference.

One individual carding segment 6 is shown in FIG. 10. This carding segment includes a plurality of carding elements with a card clothing thereon, which will be explained in detail hereinafter. The card clothings of carding segments 6, 8 have a staggered arrangement. The staggering can be preferably arranged in three rows 10, 11, 12, which are positioned one after another in the direction of carding designated by arrow K and are each extended at right angles to that direction as shown in FIGS. 2–4.

The row 10, which is the first row in the carding direction K, includes small groups 13 of teeth or tips 9, which are laterally spaced from each other at a distance which amounts to at least 50% of the middle pile length. The length "1" (FIG. 2) of the group in the direction of carding amounts to about 30 to 70% of the middle length of the pile so that, although greater lengths are possible, smaller lengths, however, permit the carding force to be increased.

The second row of tips 11 has also groups 14 of tips and these groups extend somewhat midway of distance "a" between groups 13 of the first row 10. Groups 13 of the first row 10 can also extend over the second row 11 and third row 12.

The third row of tips 12 has, on the one hand, the extensions of groups of tips 13 and 14 from the first row 10 and the second row 11 and also tips 9 in the region which has not been yet carded. This third row of tips 12 can be omitted in stationary carding segments 6 and 8 when the following lids 5 are completely set out.

To understand the arrangement shown in FIG. 2, first the mode of operation of the conventional carding machine will be explained below.

An entangled fiber layer transported by the card clothings 2*a*, 3*a* has a plurality of obliquely or diagonally lying fibers which are interlaced with one another. If this fiber layer meets the carding segment provided, for example with homogeneously arranged tips and directed transversally to the direction of carding the bundle of fibers will first of all be baffled before the front edge of the card clothing block. Thus, the card clothings of the drums, as well as the tips of the carding segments, will simultaneously engage in a rope over the entire width. The bundle of fibers thereby will be positioned in a narrow meandering line. It is understandable that the pulling of individual fibers out from the meandering-line-shaped, compressed bundle of fibers requires considerable forces. These forces which can cause, however, damaging of individual fibers can occur according to the principle of rope friction. In each case the tips 2*a*, 3*a* of the card clothings of the drums 2, 3 and tips 9 of carding segments 6, 8 are subject to very high loading contact pressure and sliding friction.

The shaping of the card clothing according to the invention prevents the formation of the fiber baffling over the entire width of the fiber layer. The fibers engaged by the tips 9 of the first row are pulled from the uncompressed fleece. The multiple loop formation is excluded at one and the same fiber because the distance from one group of tips 13 to the next group 13 is so great that the fibers can not engage both groups of the tips simultaneously.

After the fibers have been placed approximately in parallel position in the region of groups 13 of the first row 10, groups 14 of the second row 11, positioned in the gaps between groups 13, become operative. Now the position of the fibers is already oriented in the direction of carding so that the following process requires only the orientation of the fibers for the separation of short fibers and dust particles and for the final placing of fibers in parallel position.

For this process it is no longer necessary that all card flats 5 of the cover chain carry the card clothing. For example, the card clothing on each second lid can be, in the known fashion, omitted or replaced by a plate.

It is expedient that carding segments 6, 8, provided with the card clothing according to the invention, be arranged beneath the feed roll 1 against the licker-in 2 and between the cover chain 4 and licker-in 2, as close as possible to the lid chain 4. In this case each carding segment 6, 8 may be provided with three rows of the groups of the tips, as seen in FIG. 10. It is, of course, also possible that one row of the groups be arranged on one carding segment 6, 8, as seen in FIGS. 8, 9 and 11.

It is further possible that one carding segment 6, 8 with two rows of a various group-distribution and one carding segment 6, 8 with the whole card clothing are fixed one after another at the circumference of one of the drums 2, 3 (FIGS. 8 and 9).

A further embodiment of the tip arrangement of the card clothing is shown in FIG. 3. A commonly known wire card clothing disclosed, as has been mentioned above in U.S. Pat. No. 3,151,362, is depicted in FIG. 3. Plates 16 are fixed between groups of tips 13 and 14. Plates 16 must prevent releasing of the fibers from the card clothing (*2a*, *3a*) of the drums during the operation because the fibers can be released by centrifugal forces. These plates 16 have an upper surface which is lower than the upper level of the tips of the wire card clothing and are preferably fixed by gluing to the carrier 18 of the wire card clothing as shown in FIG. 8.

FIG. 4 illustrates a further embodiment of the shape of the carding clothing. The overall steel card clothing is grinded in the tip-free region (distance a), and projections or tooth stumps do not act to place the fibers of the fiber layer in parallel position but merely support the fiber layer against an undesired lifting. Tooth stumps 17 are shown in FIG. 4 and Fig. 9. Tooth stumps 17 in FIG. 4 are oval in the top plan view.

FIGS. 5 through 7 illustrate individual carding sinkers 13*a*, 14*a* and 15*a* each of which can be arranged so as to extend in the respective rows 10, 11 and 12 as shown in FIG. 2. Carding sinker 13*a*, having tips 9 over its entire length, extends over all rows 10, 11 and 12 in the direction of carding K. Carding sinker 14*a* has tips 9 extending over two thirds of its length and carding sinker 15*a* has tips 9 extending over approximately one third of its length.

The arrangement of carding elements or sinkers 13*a*, 14*a*, 15*a* on the individual carding segment 6, as well as the distribution of the rows of tips 10, 11 and 12 on the sinker elements are shown in FIG. 10.

Should a very wide spectrum of pile lengths be carded on the carding segments 6, 8, provided with the card clothing, it is possible to arrange a further row before the first row 10, which further row would have a double group distribution. All possible pile lengths can be therefore processed with the carding clothing of the invention, without requiring modifications of the carding machine.

If the card clothing according to the invention is utilized on slowly moved carding segments it is expedient to use the card clothing shown in FIG. 4. It is unimportant whether one lid carries one, two or three rows of the tips. It is, however, important that the groups of all the card flats 5 in total overlie the entire width of the tambour 3.

It will be understood that each of the elements described above, or two or more together, may also find a useful application in other types of card clothings differing from the types described above.

While the invention has been illustrated and described as embodied in card elements, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspect of this invention.

What is claimed as new and desired to be protected by Letters Patent is set forth in the appended claims:

1. A card clothing for carding segments of a carding machine, particularly flat carding machine, in which carding segments are stationarily or movably arranged against a circumference of a respective rotary drum having a card clothing on its circumference, the card clothing for the carding segments comprising a plurality of non-uniformly arranged tips cooperating with the card clothing of the respective drum, said tips being arranged in groups, said groups being arranged in at least two rows lying one after another in a direction of carding and each extending transversally to the direction of carding, each group being comprised of two to six tips located one after another and having a predetermined width, the groups in a first row, as viewed in the direction of carding, being laterally spaced from each other a distance which corresponds to at least three widths of one group of the tips, said groups each having an extension in the direction of carding corresponding to at least two widths of the groups, and the groups of a following row, as viewed in the direction of carding, being laterally offset relative to the groups of a previous row at least a distance corresponding to the width of one group.

2. The card clothing as defined in claim 1, wherein three rows of the groups of the tips are provided, said three rows lying one after another in the direction of carding, said distance in said first row corresponding to three to four widths of one group of the tips.

3. The card clothing as defined in claim 2, wherein each following row in the direction of carding includes a greater number of groups than the previous row.

4. The card clothing as defined in claim 3, wherein the distance between the groups in a second row, as viewed in the direction of carding, corresponds to about one width of the group, and wherein a third row is fully covered with tips.

5. The card clothing as defined in claim 4, wherein said three rows of groups of tips are arranged on one carding segment.

6. The card clothing as defined in claim 4, wherein each carding segment carries one of said rows, at least three carding segments carrying three of said rows being arranged one after another.

7. The card clothing as defined in claim 4, further including plates arranged between the groups in one row, said plates each having an upper surface, the level of which is lower than that of the tips in the groups.

8. The card clothing as defined in claim 4, further including projections formed between the groups in the region of said distance, said projections having stumps which are lower than the tips in the groups.

9. The card clothing as defined in claim 8, wherein said stumps are rounded.

* * * * *